US009474349B2

(12) United States Patent
Holloway

(10) Patent No.: US 9,474,349 B2
(45) Date of Patent: Oct. 25, 2016

(54) COSMETIC DISPENSER WITH FRICTIONAL RESISTANCE

(71) Applicant: HCP Packaging USA, Inc., Shelton, CT (US)

(72) Inventor: Thomas F. Holloway, Essex, MD (US)

( * ) Notice: Subject to any disclaimer, the term of this patent is extended or adjusted under 35 U.S.C. 154(b) by 0 days.

(21) Appl. No.: 14/604,552

(22) Filed: Jan. 23, 2015

(65) Prior Publication Data

US 2015/0208785 A1 Jul. 30, 2015

Related U.S. Application Data

(60) Provisional application No. 61/931,027, filed on Jan. 24, 2014.

(51) Int. Cl.
*A45D 40/06* (2006.01)

(52) U.S. Cl.
CPC ..... *A45D 40/06* (2013.01)

(58) Field of Classification Search
CPC ..... A45D 40/04; A45D 40/06; A45D 40/12; A45D 40/16
See application file for complete search history.

(56) References Cited

U.S. PATENT DOCUMENTS

| | | | |
|---|---|---|---|
| 1,153,055 | A | 9/1915 | Fuller |
| 1,244,798 | A | 10/1917 | Tharp et al. |
| 1,623,509 | A | 4/1927 | Vivaudou |
| 2,029,731 | A | 2/1936 | Maurer |
| 2,142,312 | A | 1/1939 | Heinz |
| 2,318,152 | A | 8/1941 | Gelardin |
| 2,351,395 | A | 6/1944 | Broder |
| 2,704,598 | A | 3/1955 | Casey |
| 2,815,122 | A | 12/1957 | Lerner et al. |
| 2,815,123 | A | 12/1957 | Safianoff |
| 3,001,531 | A | 9/1961 | Gazdik |
| 3,298,509 | A | 1/1967 | Hultgren |
| 3,320,962 | A | 5/1967 | Moriber et al. |
| 4,029,422 | A | 6/1977 | Pillsbury |
| 4,428,388 | A | 1/1984 | Cassai et al. |
| 4,562,923 | A | 1/1986 | Katada et al. |
| 4,666,043 | A | 5/1987 | Tahara |

(Continued)

FOREIGN PATENT DOCUMENTS

| | | |
|---|---|---|
| FR | 0979157 | 12/1950 |
| FR | 1271920 | 10/1960 |

(Continued)

*Primary Examiner* — Jennifer C Chiang
*Assistant Examiner* — Bradley Oliver
(74) *Attorney, Agent, or Firm* — Thomas P. O'Connell; O'Connell Law Firm

(57) ABSTRACT

A cosmetic dispenser with an inner body rotatably engaged with a spiral member. An elevator cup retains a cosmetic pomade, and the spiral member has spiral formations along an inner surface thereof for engaging lugs of the elevator cup that pass through longitudinal tracks in the inner body. The inner body can have lateral and longitudinal bearing surfaces with the lateral bearing surface aligned longitudinally with a longitudinal axis of relative rotation of the spiral member and the inner body and the longitudinal bearing surface orthogonal thereto. Fingers can project inwardly from the inner body to be in slidable, frictional contact with both the longitudinal and lateral bearing surfaces so that the fingers are restrained laterally and longitudinally. The fingers can be inwardly angled establish an effective circumference with the fingers tangent thereto smaller than the circumference of the lateral bearing surface.

20 Claims, 11 Drawing Sheets

(56) References Cited

U.S. PATENT DOCUMENTS

| | | | | |
|---|---|---|---|---|
| 4,671,689 | A | 6/1987 | Gueret | |
| 4,687,364 | A | 8/1987 | Kingsford | |
| 4,692,046 | A | 9/1987 | Lan | |
| 4,778,300 | A | 10/1988 | French et al. | |
| 4,820,070 | A | 4/1989 | Spatz | |
| 4,838,722 | A | 6/1989 | Katz | |
| 5,026,190 | A | 6/1991 | Longarzo | |
| 5,109,877 | A | 5/1992 | Takeda | |
| 5,172,993 | A | 12/1992 | Ackermann et al. | |
| 5,186,560 | A | 2/1993 | Holloway | |
| 5,186,561 | A | 2/1993 | Ackermann et al. | |
| 5,301,808 | A | 4/1994 | Pierson | |
| 5,324,125 | A | 6/1994 | Ackermann | |
| 5,324,126 | A | 6/1994 | Holloway et al. | |
| 5,332,325 | A | 7/1994 | Crosnier et al. | |
| 5,348,410 | A | 9/1994 | Shozi et al. | |
| 5,349,972 | A | 9/1994 | Dirksing et al. | |
| 5,597,254 | A | 1/1997 | Vasas | |
| 5,609,430 | A | 3/1997 | Mazzola et al. | |
| 5,715,848 | A | 2/1998 | Conley, Jr. | |
| 5,791,799 | A | 8/1998 | Oehlhorn | |
| 5,791,800 | A | 8/1998 | Katz | |
| 5,842,803 | A * | 12/1998 | Furnell | A45D 40/06 401/78 |
| 5,842,805 | A | 12/1998 | Pierpont | |
| 5,851,078 | A | 12/1998 | Bow et al. | |
| 5,888,004 | A | 3/1999 | Bouix | |
| 5,899,621 | A | 5/1999 | Wang | |
| 5,927,881 | A | 7/1999 | Yang | |
| 5,951,186 | A | 9/1999 | Lhuisset | |
| 5,988,917 | A | 11/1999 | Sheffler et al. | |
| 6,010,265 | A | 1/2000 | Bouix | |
| 6,126,351 | A | 10/2000 | Gueret | |
| 6,200,047 | B1 | 3/2001 | Holloway | |
| 6,200,049 | B1 | 3/2001 | Pinhel et al. | |
| 6,231,254 | B1 | 5/2001 | Holloway | |
| 6,231,256 | B1 | 5/2001 | Kingsford et al. | |
| 6,293,721 | B1 | 9/2001 | Bow et al. | |
| 6,371,129 | B1 | 4/2002 | Le Bras-Brown et al. | |
| 6,375,374 | B2 | 4/2002 | Gueret | |
| 6,405,737 | B1 | 6/2002 | Sheffler et al. | |
| 6,412,999 | B1 | 7/2002 | Pierpont | |
| 6,540,422 | B2 | 4/2003 | Torii | |
| 6,543,953 | B1 | 4/2003 | Kim | |
| 6,718,990 | B1 | 4/2004 | Chastain et al. | |
| 6,843,611 | B2 | 1/2005 | Blondeel et al. | |
| 6,895,628 | B1 | 5/2005 | Anderson | |
| 7,237,973 | B1 | 7/2007 | Lou | |
| 7,325,991 | B2 | 2/2008 | Holloway | |
| 7,357,588 | B2 | 4/2008 | Liard | |
| 7,500,799 | B2 | 3/2009 | Holloway | |
| 7,883,286 | B2 | 2/2011 | Thiebaut | |
| 2004/0184865 | A1 | 9/2004 | Carroll | |
| 2006/0216103 | A1 | 9/2006 | Bielecki et al. | |
| 2006/0291948 | A1 | 12/2006 | Holloway | |
| 2007/0217857 | A1 | 9/2007 | Ho | |
| 2007/0280772 | A1 | 12/2007 | Mika | |
| 2008/0163881 | A1 | 7/2008 | Saunders et al. | |
| 2010/0284724 | A1 | 11/2010 | Cardia | |

FOREIGN PATENT DOCUMENTS

| | | |
|---|---|---|
| FR | 2900547 | 11/2007 |
| FR | 2906114 | 3/2008 |
| GB | 2161788 | 1/1986 |
| WO | WO03015567 | 2/2003 |
| WO | WO2005032301 | 4/2005 |

* cited by examiner

COSMETIC DISPENSER WITH FRICTIONAL RESISTANCE

FIELD OF THE INVENTION

The present invention relates generally to cosmetic containers and dispensers. Stated more particularly, disclosed herein is a device for containing and dispensing cosmetics with a frictional resistance exhibited between relatively rotatable inner body and spiral member components.

BACKGROUND OF THE INVENTION

In a typical prior art lipstick dispenser, an elevator cup retains a body of lipstick for axial extension and retraction by a swiveling of a base portion in relation to a body portion of the dispenser. Dispensers have commonly employed a cam member with helical threads formed therealong that is rotatably associated with a tubular inner body. The inner body is normally formed with opposed longitudinal tracks. The elevator cup typically has opposed lugs that are received through the longitudinal track and associated with the helical threads of the cam member. Under this arrangement, a rotation of the cam member in relation to the tubular innerbody induces the desired axial movement of the elevator cup and the retained body of lipstick as the lugs of the elevator cup slide along the helical threads and the longitudinal tracks.

While effective for its essential purpose, this basic lipstick dispensing design has demonstrated plural disadvantages that have been well recognized in the cosmetic industry. For example, there can be axial and radial looseness between the various components of the lipstick dispenser that can lead to a perceived lack of quality of the device and, by inference, the retained product. The lipstick product can also be perceived as being inferior when the swivel torque required to operate the dispenser is excessively light or inconsistent. Still further, a loosely retained elevator cup can wobble thereby resulting in damage to the product and again reducing the perceived quality thereof.

Conversely, it has been found that a lipstick mechanism with a smooth feel and with consistent torque characteristics lends a perception of quality to the device with a resultant increase in the perceived value of the product. A frictional drag of sufficient significance imparts a firm feel to the device that gives an impression of luxury. Preferably, the frictional drag will remain generally constant during extension and retraction of the lipstick and without regard to whether the dispenser is substantially full or substantially exhausted of cosmetic.

Prior art inventors have proposed numerous arrangements for meeting these needs and goals. In one construction, flexible tabs have portions that project radially from the inner body to provide a frictional engagement with the cam or spiral member. That frictional engagement is intended to provide the dispenser with the desired braking effect and constant swivel torque. Other arrangements have produced a similar frictional engagement by the introduction of fins or ribs on the inner body. It has been found, however, that the tabs and ribs can plastically deform over time thereby losing effectiveness. Additionally, certain of these arrangements can yield an inconsistent swivel torque during travel of the elevator cup since the effective diameter of the relatively moveable components can vary along their length thereby changing the frictional drag in an undesirable manner.

The present inventor has proposed improvements in relation to cosmetic dispensers, such as with U.S. Pat. No. 7,325,991 for a Cosmetic Dispenser with Frictional Drag and U.S. Pat. No. 7,500,799 for a Cosmetic Dispenser with Frictional Swivel Action. Under the teachings of the '991 patent, a protuberance, which can be inflexible, projects from a shoulder portion of the inner body and is aligned with a flexible wall segment of a spiral member to produce a frictional drag therebetween. In the '799 patent, frictional draft was produced between a cam member and an adapter member by one or more drag protuberances therebetween.

Nonetheless, it has come to be appreciated that needs remain in the art of extendable and retractable cosmetic dispensers. For example, under many prior art mechanisms, the existence of multiple points or locations for generating frictional torque renders it more difficult to control the torque within desired swivel torque ranges. It has been found that customers typically prefer torque resistance from approximately around 2 in. oz. to 6 in. oz. However, it must also be recognized that there is a torque range required for the filling equipment to function smoothly. If the swivel torque is too high, then the machine may turn the elevator cup out of the track on the spiral cam. If the torque is too low, the cosmetic dispenser will feel cheap, and the elevator cup will have a tendency to move when the dispenser is not in use. Moreover, the swivel toque needs to be high enough to prevent the elevator cup from pushing inadvertently retracting when the consumer applies the pomade.

As suggested above, it is desired that swivel torque be consistent throughout the entire processes of elevating or lowering the elevator cup. Under many prior art constructions, the swivel torque varies during the elevation and retraction of the cup, often because such constructions not only had multiple points of contact but also because some of these contact points were moving. For instance, where bumps on the outside wall of the elevator cup are designed to interfere with inside wall of the inner body, the openness of the top of the inner body would produce less resistance than the closed bottom.

Many manufacturers have resorted to adding lubrication seeking to keep swivel torque within the desired range and to make for a smooth feel during extension and retraction. Even if those benefits are achieved, however, the introduction of lubrication creates other issues. For instance, swivel torque can be rendered undesirably low, and lubricant can sometimes get on to the pomade or on the outside of the case.

With a knowledge of the foregoing, the present inventor has appreciated that there is a need for a cosmetic dispenser capable of exhibiting smooth extension and retraction with substantially consistent swivel torque not only over the course of a given extension and retraction cycle but also over the life of the cosmetic dispenser. It is equally clear that there is a need for such a dispenser that is operative without a need for the introduction of lubricant into the system thereby avoiding the potentially deleterious effects thereof.

SUMMARY OF THE INVENTION

The present invention has as its most broadly stated object the providing of a dispenser for cosmetics, such as lipsticks, that exhibits smooth extension and retraction with substantially consistent swivel torque not only over the course of a given extension and retraction cycle but also over the life of the cosmetic dispenser.

A further object of the invention is to provide a cosmetic dispenser that is operative without a need for the introduction of lubricant into the system thereby avoiding the potentially deleterious effects thereof.

Another object of embodiments of the invention is to provide a cosmetic dispenser that demonstrates a frictional drag during operation of the dispenser to impart a firm feel to the user and provides an impression of quality and luxury during operation.

Still another object of embodiments of the invention is to provide such a cosmetic dispenser that is relatively efficient in construction, assembly, and operation.

An additional object of embodiments of the invention is to provide a cosmetic dispenser that does not exhibit significant static friction when relative movement of the components of the dispenser is initiated and that emits minimized noise during operation to give a sound and feel of quality.

These and further objects and advantages of embodiments of the invention will become obvious not only to one who reviews the present specification and drawings but also to one who has an opportunity to make use of an embodiment of the cosmetic dispenser disclosed herein. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the invention.

In one embodiment of the invention, the cosmetic dispenser has an inner body with a proximal end, a distal end, a body portion, and at least one longitudinal track that communicates along a substantial length of the body portion. An elevator cup is provided for retaining a pomade of cosmetic wherein the elevator cup has an annular peripheral wall, a base portion, and at least one lug that projects outwardly from the peripheral wall. A spiral member has a proximal end, a distal end, and a body portion with at least one spiral formation along an inner surface thereof for engaging the at least one lug of the elevator cup. The spiral member and the inner body are rotatably engaged with a longitudinal axis of relative rotation with the body portion of the inner body received into the body portion of the spiral member. A first annular bearing surface is retained relative to one of the inner body or the spiral member, and a second annular bearing surface is retained relative to the inner body or the spiral member adjacent to the first annular bearing surface. The first annular bearing surface is disposed at a non-zero angle relative to the second annular bearing surface. A plurality of fingers project from the other of the spiral member or the inner body, and the fingers are in slidable contact with both the first and second annular bearing surfaces. With that, the fingers are restrained by the first annular bearing surface in a first direction and by the second annular bearing surface in a second direction.

In certain embodiments of the cosmetic dispenser, the first annular bearing surface can be a lateral bearing surface that is substantially aligned longitudinally with the longitudinal axis of relative rotation whereby lateral force can be applied to the lateral bearing surface by the plurality of fingers. The first annular bearing surface can have a diameter and a circumference, and the plurality of fingers can establish an effective circumference with the fingers tangent thereto smaller than the circumference of the first annular bearing surface. In some practices of the invention, the plurality of fingers are inwardly angled to establish the effective circumference with the fingers tangent thereto smaller than the circumference of the first annular bearing surface. The second annular bearing surface can be a longitudinal bearing surface that is not aligned with the longitudinal axis of relative rotation whereby longitudinal force can be applied to the longitudinal bearing surface by the plurality of fingers. For instance, the second annular bearing surface can be generally concentric with and generally orthogonal to the longitudinal axis of relative rotation.

Embodiments of the cosmetic dispenser can have the plurality of fingers project from the spiral member, and the first and second annular bearing surfaces can be retained relative to the inner body. For instance, the inner body can have a base portion disposed at a proximal end of the inner body. The base portion can project beyond the body portions of the inner body and the spiral member when the spiral member and the inner body are engaged. In such constructions, the first annular bearing surface could comprise a smooth annular bearing wall interposed between the base portion of the inner body and the body portion of the inner body.

As disclosed herein, a cap could be fixed to the base portion of the inner body, and the second annular bearing surface could be formed by a portion of the cap. The cap could, for example, be retained by an annular ridge and facets on the base portion of the inner body to prevent inadvertent longitudinal and rotational displacement of the cap. In other embodiments, the second annular bearing surface could be formed by an annular ridge retained by the inner body, such as by being formed integrally therewith.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

Figure 2:
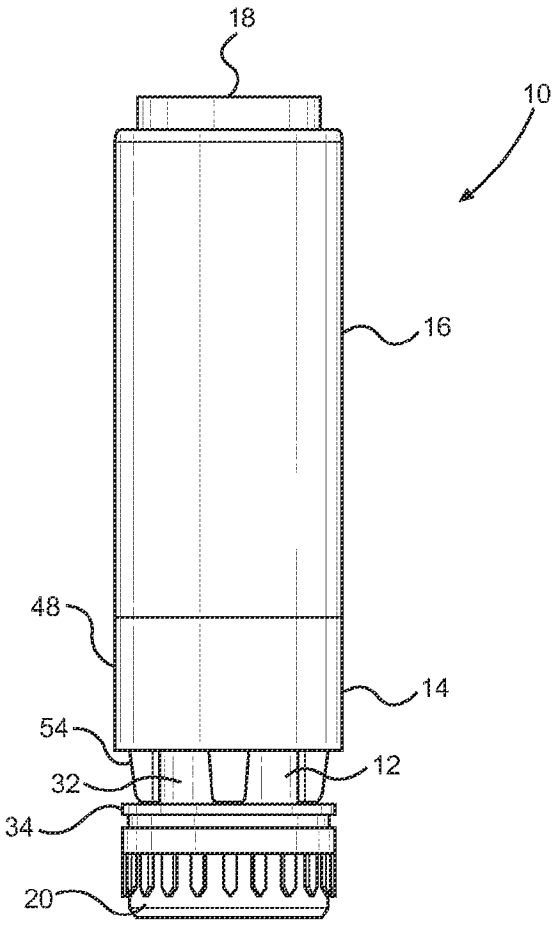
FIG. 2 is a view in front elevation of the cosmetic dispenser of FIG. 1.
Figure 1:
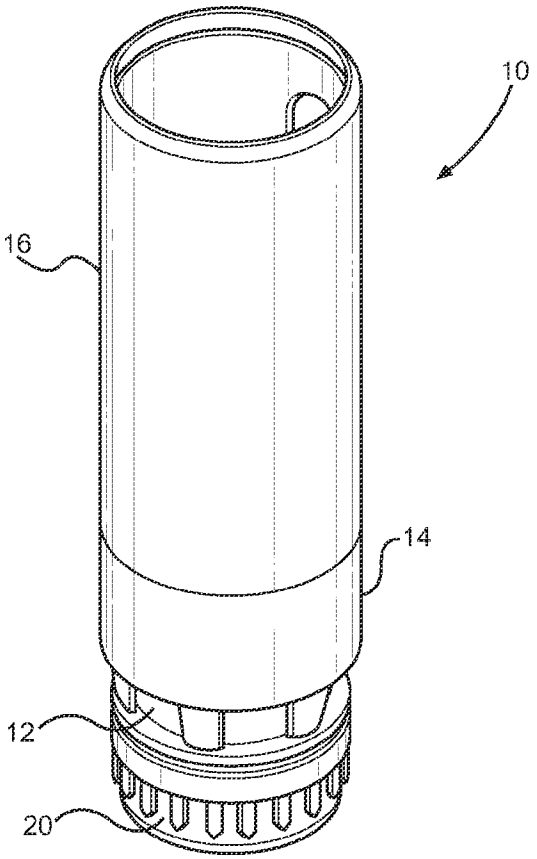
FIG. 1 is a perspective view of a cosmetic dispenser according to the present invention.

Any notes, dimensions, relative dimensions, and details on the drawings are incorporated herein by reference but should not be interpreted as limiting the invention in any manner.

DETAILED DESCRIPTION OF PREFERRED EMBODIMENTS

The cosmetic dispenser disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Therefore, before any particular embodiment of the invention is explained in detail, it must be made clear that the following details of construction and illustrations of inventive concepts are mere examples of the many possible manifestations of the invention.

With this in mind and looking more particularly to the accompanying figures, a first exemplary embodiment of a cosmetic dispenser pursuant to the present invention is indicated generally at 10 in FIGS. 1 through 4. The cosmetic dispenser 10 is founded on a tubular inner body 12 that is rotatably engaged with a spiral member 14. As will be described more fully hereinbelow, a relative rotation between the inner body 12 and the spiral member 14 yields an axial movement of an elevator cup 18, which is employed to retain a member of lipstick 100, between the extended disposition depicted in FIG. 4 and the retracted disposition depicted in FIG. 3. A tubular shell 16, which can be essentially decorative in nature, can partially or substantially encase the spiral member 14 and, derivatively, the elevator cup 18 disposed therewithin.

For ease of reference, the cosmetic dispenser 10 can be considered to have a proximal end defined as the base of the inner body 12 while the tip of the tubular shell 16 can be considered to define a distal end of the cosmetic dispenser 10. Each component of the cosmetic dispenser 10 can be described under that convention. It should be noted that, while the term member is employed in relation to the spiral member 14 and possibly other components of the cosmetic dispenser 10, each could be formed unitarily as a single piece of material or from multiple subcomponents joined by any effective method to form the respective structure. Just as clearly, except as otherwise described or claimed, the inner body 12, the spiral member 14, the elevator cup 18, and the tubular shell 16 can be formed from any suitable material and by any effective method.

Figure 14:
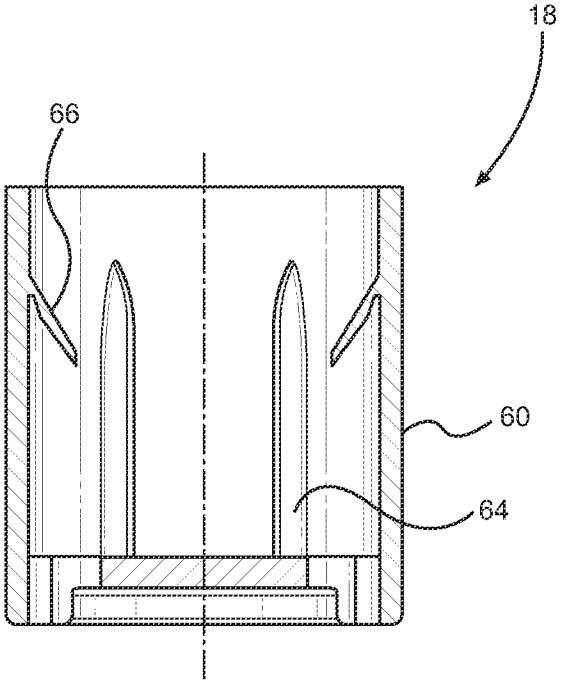
FIG. 14 is a cross section of the elevator cup of FIG. 13.
Figure 13:
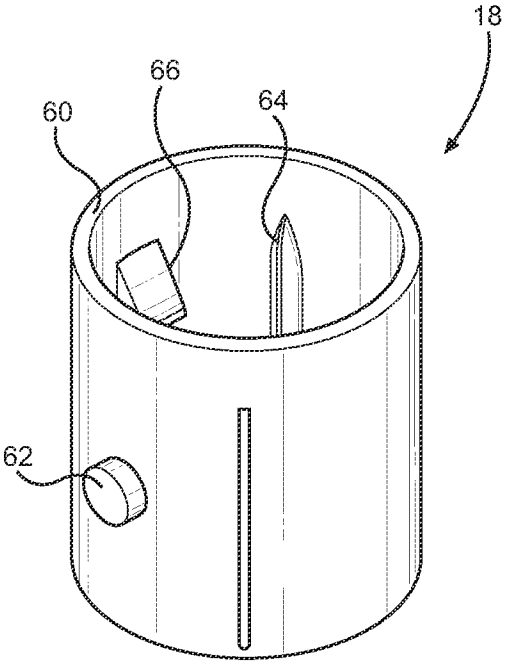
FIG. 13 is a perspective view of an elevator cup for the cosmetic dispenser of FIG. 1.

The elevator cup 18 is shown apart from the remainder of the cosmetic dispenser 10 in FIGS. 13 and 14. There, the elevator cup 18 can be seen to have an open inner volume for receiving a proximal portion of a member of lipstick (not shown). The open inner volume is defined by an annular peripheral wall 60 and a proximal base portion. A plurality of fins 64 project inwardly from the peripheral wall 60. The fins 64 can project along radii of the elevator cup 18. Alternatively, the fins 64 could project in an angled relationship relative to tangents of the annular peripheral wall 60. The fins 24 can have a distal taper for enabling a most efficient receipt and engagement of the member of lipstick. In this example, the fins 64 are longitudinally aligned with the elevator cup 18 and the cosmetic dispenser 10 in general. A plurality of hook members 66 project downwardly from the peripheral wall 60 thereby to prevent displacement of a pomade (not shown). One or more elevator lugs 62 can project outwardly from the elevator cup 18, such as from the peripheral wall 60, for engaging the inner body 12 and the spiral member 14 as will be described below. In the depicted example, first and second elevator lugs 62 project from opposed sides of the elevator cup 18 from a mid-portion thereof.

Figure 6:
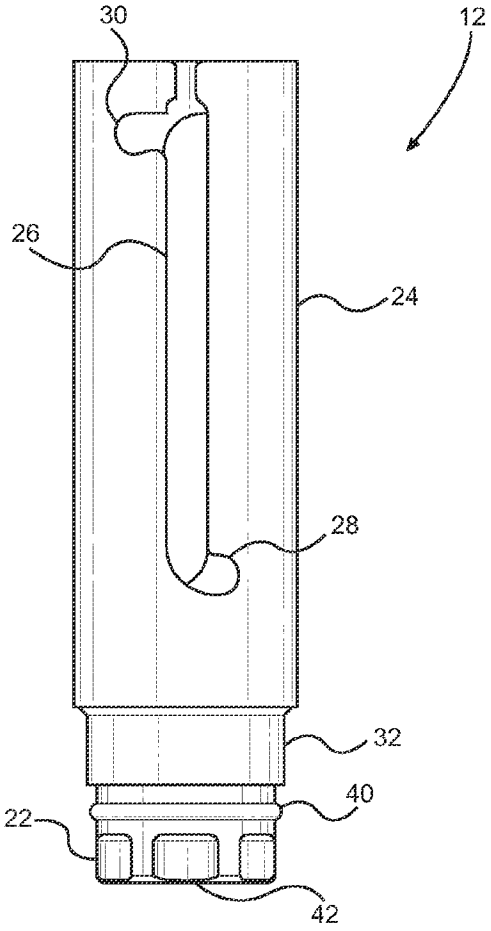
FIG. 6 is a view in front elevation of the inner body of FIG. 5.
Figure 5:
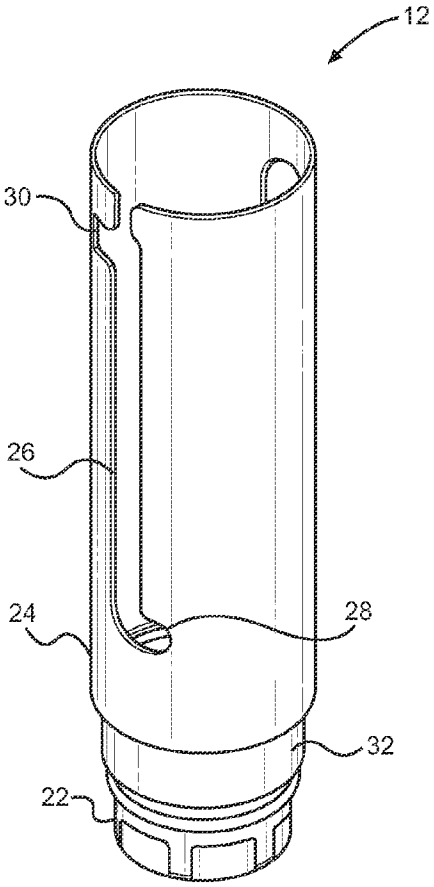
FIG. 5 is a perspective view of an inner body pursuant to the instant invention.

The tubular inner body 12 is shown apart from the remainder of the cosmetic dispenser 10 in the views of FIGS. 5 and 6. The inner body 12 has a distally disposed body portion 24 for being received into a body portion 50 of the spiral member 14, which is seen alone in FIGS. 9 through 12. The body portion 24 of the inner body 12 has an outer diameter slightly less than the inner diameter of the body portion 50 of the spiral member 14. A base portion 22 is disposed at a proximal end of the inner body 12, such as by being formed integrally therewith, and a smooth annular bearing wall 32 is interposed between the body portion 24 and the base portion 22. The annular bearing wall 32 is concentric with the inner body 24 and is longitudinally aligned with the body portion 24 and the inner body 12 in general. The annular bearing wall 32 thereby presents what can be referred to as a lateral bearing surface in that lateral force can bear against the annular bearing wall 32.

Figure 8:
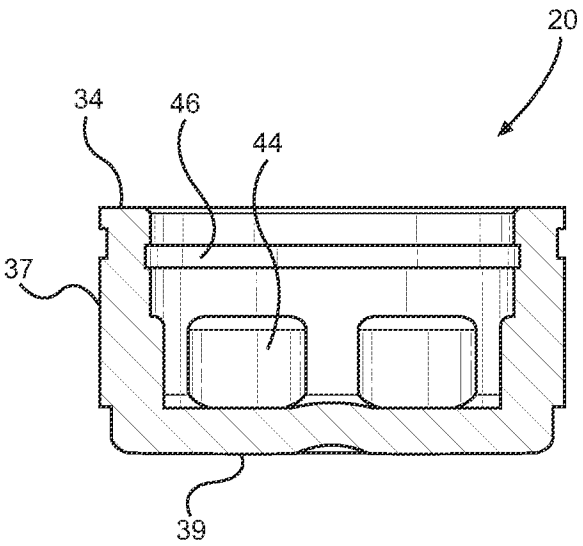
FIG. 8 is a cross section of the end cap of FIG. 7.
Figure 7:
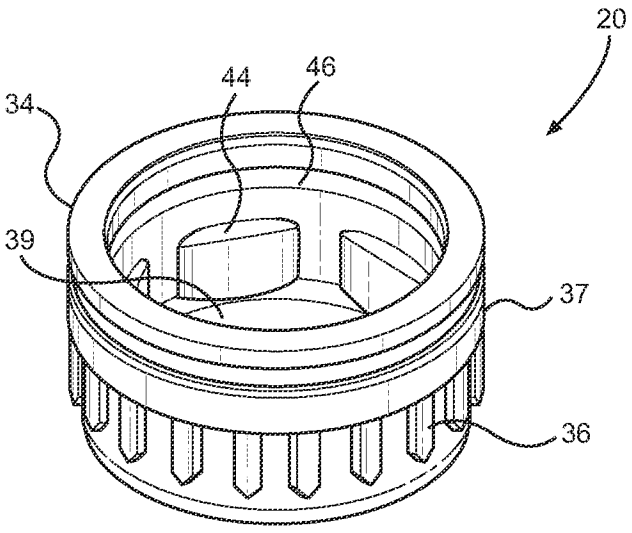
FIG. 7 is a perspective view of an end cap for the inner body of FIG. 5.
Figure 10:
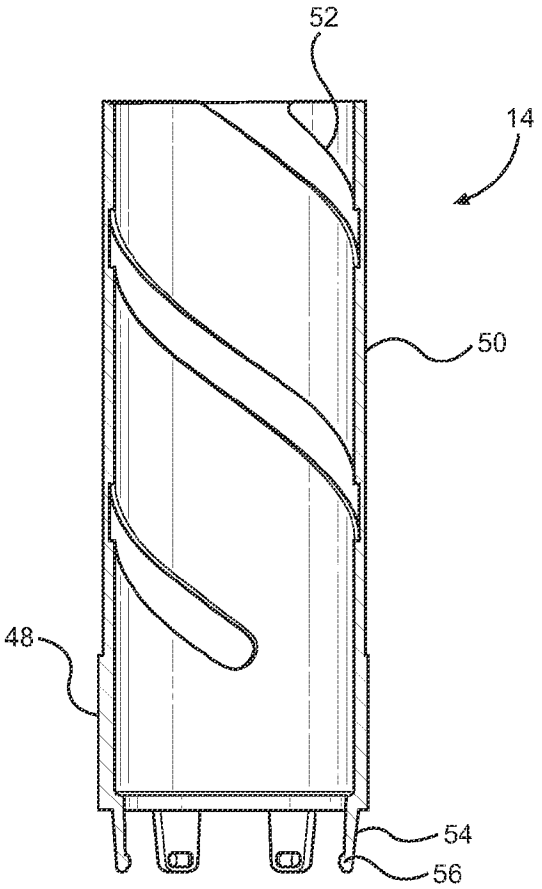
FIG. 10 is a cross section of the spiral cam of FIG. 9.
Figure 9:
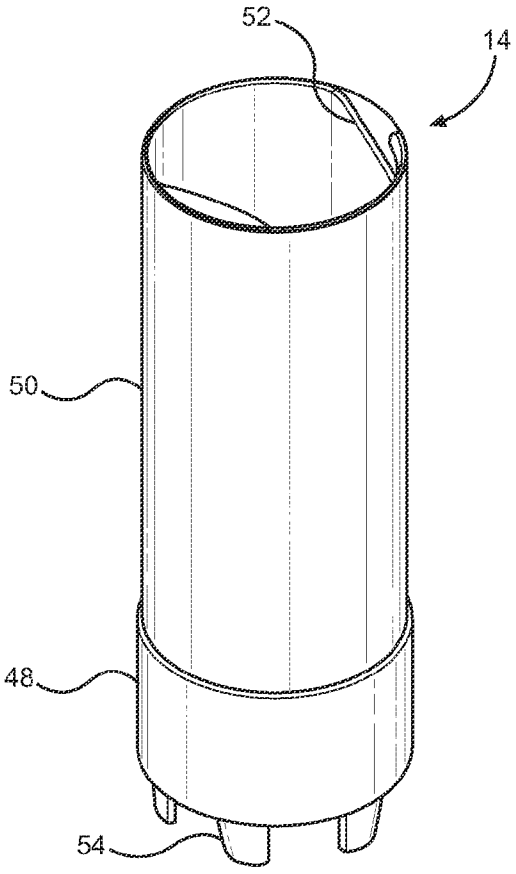
FIG. 9 is a perspective view of a spiral cam for the cosmetic dispenser of FIG. 1.
Figure 12:
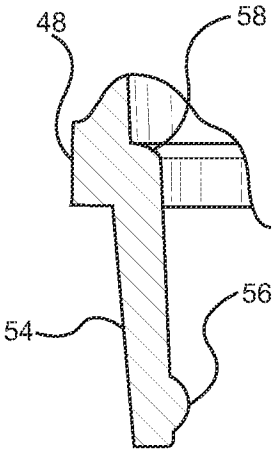
FIG. 12 is an amplified cross section of a friction tooth of the spiral cam of FIG. 9.
Figure 11:
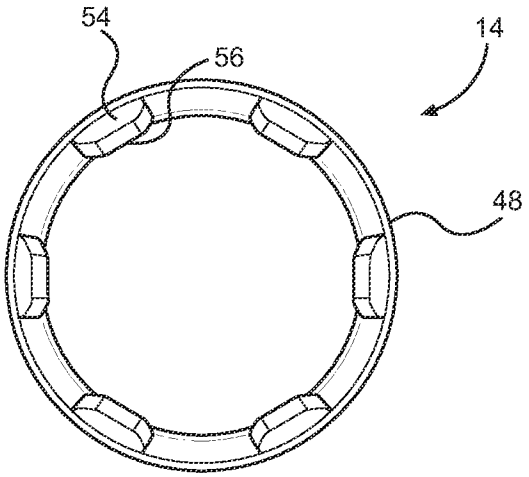
FIG. 11 is a bottom plan view of the spiral cam of FIG. 9.

An end cap 20, seen apart in FIGS. 7 and 8, is engaged with the base portion 22 of the inner body 12. The end cap 20 is defined by a peripheral wall 37 and a base 39. The peripheral wall 37 terminates in a smooth bearing surface 34 that is generally orthogonal to the axis of rotation of the inner body 12 when the cap 20 is coupled thereto. The smooth bearing surface 34 thereby presents what can be referred to as a longitudinal bearing surface in that longitudinal force can bear against the smooth bearing surface 34. The end cap 20 is fixed against longitudinal movement in relation to the inner body 12 by engaging features on the end cap 20 and the inner body 12. In this embodiment, the engagement is achieved by a snap fit engagement between an annular channel 46 in the end cap 20 and an annular ridge 40 disposed adjacent to the proximal end of the inner body 12. The end cap 20 is fixed to rotate with the inner body 12 by engaging feature on the end cap 20 and the inner body 12. Here, the engagement is carried forth by a plurality of facets 42 disposed at a proximal end portion of the inner body and corresponding facets 44 formed on the inner surface of the peripheral wall of the end cap 20. The end cap 20 has gripping ridges 36 spaced along the outer peripheral surface thereof to facilitate rotation of the cap 20 and the inner body 12, which is fixed to rotate therewith.

The inner body 12 has first and second opposed longitudinal tracks 26 that communicate along a substantial length of the body portion 24 of the inner body 12. The longitudinal tracks 26 are disposed in general opposition and pass entirely through the body portion 24. With this, the elevator lugs 62 of the elevator cup 18 pass through the longitudinal tracks 26 to engage the opposed spiral channels 52 of the spiral member 14. A first longitudinal track 26 can have closed proximal and distal ends while a second longitudinal track 26 can have a closed proximal end and an aperture at the distal end thereof for enabling a receipt of the elevator lugs 62 of the elevator cup 18 and for enabling a radial compression of the body portion 24 of the inner body 12 during an insertion of the body portion 24 of the inner body 12 into the body portion 50 of the spiral member 14.

The first and second longitudinal tracks 26 can have distal lateral track segments 30 at the distal ends thereof and proximal lateral track segments 28 at the proximal ends thereof. The distal lateral track segments 30 can be employed to lock the elevator cup 18 in the extended disposition of FIG. 4, and the proximal lateral track segments 28 can lock the elevator cup 18 in the retracted disposition of FIG. 3. With this, inadvertent movement, namely unintended extension or retraction, of the elevator cup 18 and the retained pomade can be prevented.

With combined reference to FIGS. 9 through 12, one can perceive that the cylindrical spiral member 14 has a proximally disposed skirt 48 and a distally disposed body portion 50. The skirt 48 has an outer diameter greater than the outer diameter of the body portion 50 so that the tubular shell 18 can be received to encase the body portion 50 as seen, for example, in FIGS. 1 through 4. The tubular shell 18 can have an outer diameter approximately equal to the outer diameter of the skirt 48 and an inner diameter marginally larger than the outer diameter of the body portion 50 whereby a substantially consistent cylindrical outer surface is established along the outer surface of the tubular shell 18 and the outer surface of the skirt 48.

As will be described more fully hereinbelow, the spiral member 14 has an inwardly projecting shoulder 58 formed at the proximal end thereof. The shoulder 58 has an inner diameter marginally greater than the outer diameter of the annular bearing wall 32 of the inner body 12 but less than the outer diameter of the body portion 24 of the inner member 12. With that, the base portion 22 and the annular bearing wall 32 of the inner body 12 can be received through the proximal end of the spiral member 14 until the proximal end of the body portion 24 of the inner member 12 contacts the shoulder 58 of the spiral member 14 as illustrated, for example, in FIGS. 3 and 4.

A plurality of fingers 54 project proximally from the proximal end of the skirt 48 of the spiral member 14. More particularly relative to the present embodiment, six fingers 54, which in this example are spaced evenly at 60-degree intervals on center, extend proximally from the proximal end of the spiral member 14. As can be perceived by combined reference to FIGS. 10 through 12, the fingers 54 in this embodiment are integrally formed with the remainder of the spiral member 14, but that need not necessarily be the case. The fingers 54 are configured to establish a distance between the tips 56 of opposed fingers 54 and an effective circumference with the tips 56 of the fingers 54 tangent thereto smaller than the respective diameter and circumference of the annular bearing wall 32 of the inner body. In this example, the distance between tips 56 and the effective circumference are achieved by an inward angling of the fingers 54 together with protuberances forming portions of the tips 56 of the fingers 54. It will be understood, of course, that the distance between the tips 56 and the effective circumference could be achieved in numerous ways, each within the scope of the invention except as it might be expressly limited by the claims. When the cosmetic dispenser 10 is fully assembled as in FIGS. 1 through 4, the tips 56 of the fingers 54 thus press against the annular bearing wall 32 to provide smooth and consistent frictional resistance to the rotation of the inner body 12 relative to the spiral member 14.

Moreover, the fingers 54 have lengths and longitudinal dimensions sufficient to cause the ends of the fingers 54 to be in frictional engagement with the smooth, longitudinal bearing surface 34 of the end cap 20 when the cosmetic dispenser 10 is fully assembled. As such, further frictional resistance is created between the spiral member 14, through the fingers 54, and the inner body 12, through the cap 20 secured thereto. Simultaneously, outward deflection of the fingers 54 is prevented by the smooth bearing surface 34 and the end cap 20 in general. The smooth bearing surface 34 and the end cap 20 act as a slidable mechanical restraint against the outward deflection of the fingers 54. Still further, the engagement of the fingers 54, the annular bearing wall 32, and the smooth bearing surface 34 cooperate to minimize or eliminate any relative play between the components of the cosmetic dispenser 10.

The body portion 50 of the spiral member 14 has a smooth outer wall surface and an inner wall surface with spiral formations, which in this example comprise helical or spiral channels 52, communicating therealong. It will be noted that, although spiral channels 52 are depicted in the instant embodiment, the spiral formations alternatively could comprise spiral threads, spiral ridges, or any other spiral or helical arrangement. In any case, first and second spiral channels 52 or other spiral formations can be disposed in general opposition to one another thereby to enable a receipt and engagement of the opposed elevator lugs 62 of the elevator cup 18.

The inner diameter of the distal body portion 50 of the spiral member 14 and the outer diameter of the peripheral wall 60 of the elevator cup 18 can be calibrated to allow the elevator cup 18 to slide axially in relation to the spiral member 14, such as by having the outer diameter of the peripheral wall 60 be slightly less than the inner diameter of the distal body portion 50. Similarly, the elevator lugs 62 and the opposed spiral channels 52 can be dimensioned to enable a sliding of the elevator lugs 62 along the spiral channels 52, such as by having the distance between the outer tips of the elevator lugs 62 slightly less than the diameter established by the spiral channels 52.

Under this arrangement, the inner body 12 can be rotatably engaged with the spiral member 14 as shown, for example, in FIGS. 1 through 4. The body portion 24 of the inner body 12 can be received within the body portion 50 of the spiral member 14 with the fingers 54 of the spiral member 14 overlying and pressing laterally against the annular bearing surface 32 to provide lateral frictional resistance to the rotation of the inner body 12 relative to the spiral member 14. Simultaneously, the distal ends of the fingers 54 frictionally engage the bearing surface 34 such that the fingers 54 press longitudinally against the bearing surface 34 to provide longitudinal frictional resistance to rotation of the inner body 12 relative to the spiral member 14.

Figure 4:
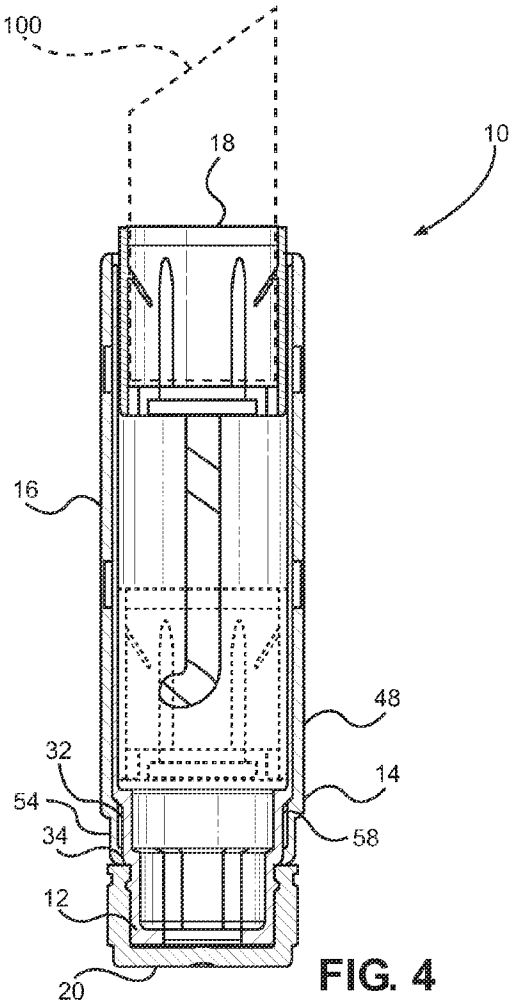
FIG. 4 is a cross section of the cosmetic dispenser of FIG. 1 in an extended disposition.
Figure 3:
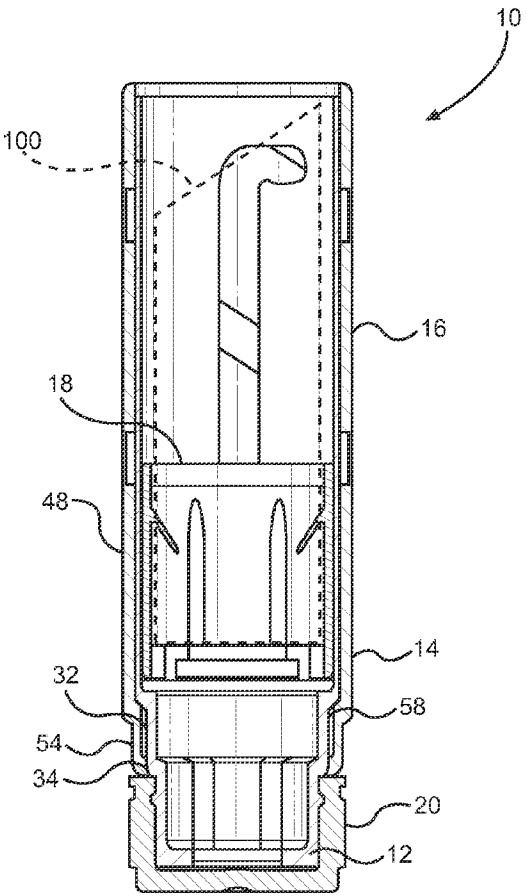
FIG. 3 is a cross section of the cosmetic dispenser of FIG. 1 in a retracted disposition.

The end cap 20, which is fixed to rotate with the inner body 12, projects proximally beyond the fingers 54 of the spiral member 14 to enable a manual rotation of the inner-body 12 in relation to the spiral member 14. The elevator cup 18, and thus a pomade 100 as shown in FIGS. 3 and 4, can be manipulated between the retracted configuration depicted in FIG. 3 and the extended configuration depicted in FIG. 4 by a rotation of the inner body 12 in relation to the spiral member 14. To do so, a user could engage the inner body 12, such as by and through a gripping of the end cap 20 with a first hand, and then engage the spiral member 14 either directly or by use of the shell 16, such as with a second hand. Next, torque sufficient to rotate the inner body 12 in relation to the spiral member 14 can be applied. As the inner body 12 is rotated in relation to the spiral member 14, the elevator cup 18 will be prevented from rotating in relation to the inner body 12 by engagement of the lugs 62 with the longitudinal tracks 26. With that, the elevator lugs 62 will slide along the helical tracks 52 to yield an axial movement of the elevator cup 18 and the retained pomade 100. Relative rotation in a first direction will induce an extension of the elevator cup 18 while relative rotation in a second, opposite direction will induce a retraction of the elevator cup 18 and the retained pomade 100.

So constructed and assembled, the lateral and longitudinal frictional resistance between the inner body 12 and the spiral member 14 together and individually tend to cause the cosmetic dispenser 10 to extend and retract smoothly and with consistent torque characteristics. Furthermore, the cosmetic dispenser 10 minimizes perceptible looseness and play between components. The cosmetic dispenser 10 thus imparts a firm and luxurious feel to the user that gives the perception of quality as to the cosmetic dispenser 10 and the pomade 100 product retained thereby.

The dimensions of the components of the cosmetic dispenser 10 could vary within the scope of the invention as could the materials from which they are formed. Nonetheless, the illustrated and described possible and relative dimensions and materials in relation to one potential embodiment of the cosmetic dispenser 10 may assist in a better understanding of the invention. For convenience, reasonable tolerances will be assumed. It will be noted that the particular dimensions and dimensional relations will vary depending on the needs and goals of the manufacturer and on the materials from which the components are formed.

Advantageously, the cosmetic dispenser 10 is operative with the only location of interference being where the necessary frictional swivel torque is created. This compares favorably to many prior art designs where multiple points generated the frictional torque. Where multiple points are employed, it becomes difficult to control the torque within a desired swivel torque range. Furthermore, in view of the constant location of the frictional engagement, the swivel torque tends to be consistent throughout the entire extension and retraction processes. This again compares favorably to many prior art designs where swivel torque often varies during elevation or retraction of the elevator cup since the variation commonly derived not only from the need for multiple points of frictional contact but also since some or all of the contact points moved during operation, which tends to hamper consistency. For example, with many prior art cases, bumps on the outside wall of the elevator cup interfere with the inside wall of the inner body, but the inner body is open at the top so that the torque tends to be lower when the elevator cup is moving in the upper portion of the inner body as compared to the lower portion. Manufacturers of such designs may be forced to introduce lubrication to keep the torque within the desired range and to make operation of the device feel smooth, but the present structure seeks to be operative with smooth and consistent friction without a need for lubrication, which is advantageous for plural reasons. While designs have been developed that purport to be operative without lubrication, they commonly require additional components, which is undesirable. Additional components and assembly steps are not necessary under the disclosed structure.

In addition to the structural improvements disclosed herein, preferred embodiments of the cosmetic dispenser 10 exploit optimal material selection for improved performance. For instance, low coefficient of friction materials permit the initiation of movement without perceptible static friction. Moreover, rotational noise will be minimized and relative component displacement will be prevented to give a sound and feel of quality. Embodiments of the cosmetic dispenser 10 using engineering grade polyoxymethylene (POM) for the spiral member 14 contribute to the ability to avoid the use of lubrication while functioning as described while also avoiding fatigue so that consistent swivel torque will be maintained throughout the life of the cosmetic dispenser 10. By employing outward stress on the fingers 54 to produce frictional resistance as shown and described, the fingers 54 are designed not to fatigue over time.

While the annular bearing wall 32 in the present embodiment is depicted as being adjacent to the base portion 22 of the inner body 12, it will be noted that, except as the invention might be expressly limited by the claims, the lateral bearing surface formed by the annular bearing wall 32 could be otherwise disposed, such as at a mid-portion or at the distal end of the inner body 12. It should also be appreciated that the fingers 54, the lateral bearing surface, and the longitudinal bearing surface could be otherwise configured. For instance, rather than having the fingers 54 project from the component comprising the spiral member 14, the fingers 54 could project from another component of the cosmetic dispenser 10, such as from the inner body 12. Under such a construction, the lateral and longitudinal bearing surfaces could be disposed on or retained by, for instance, the spiral member 14. Moreover, in certain embodiments, there might not be a defined line between the lateral bearing surface and the longitudinal bearing surface.

Figure 16:
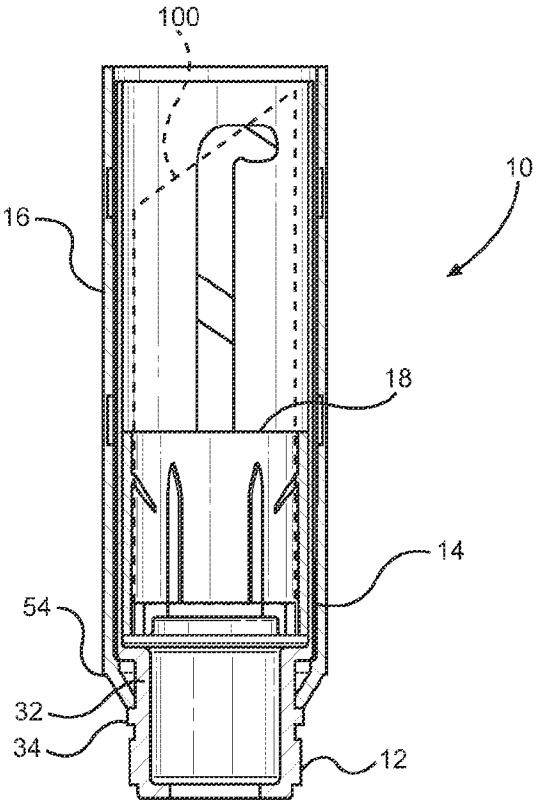
FIG. 16 is a cross section of the cosmetic dispenser of FIG. 15 in a retracted disposition.
Figure 15:
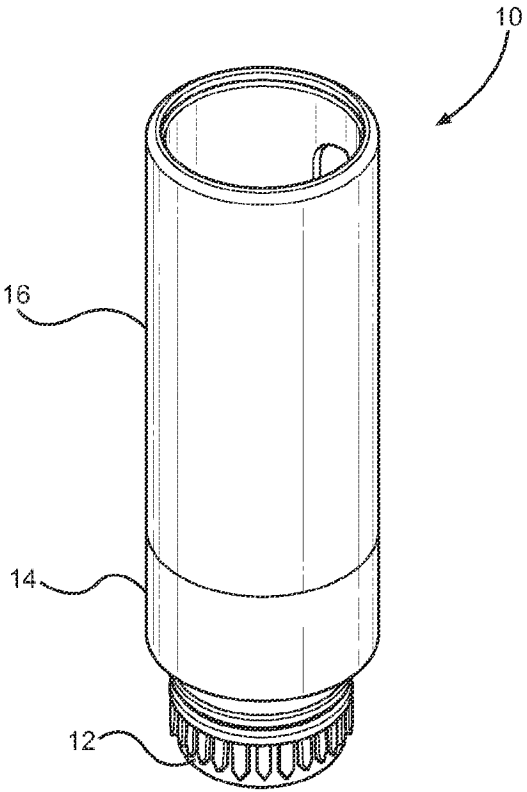
FIG. 15 is a perspective view of an alternative cosmetic dispenser according to the present invention.
Figure 17:
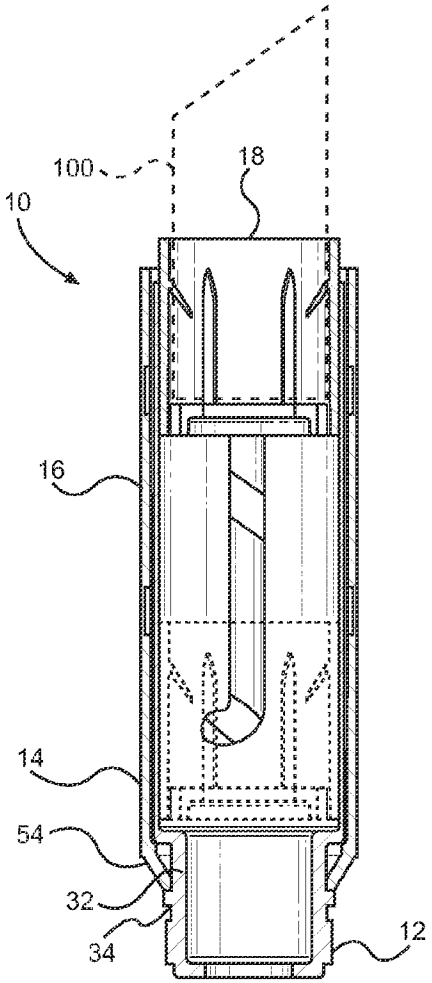
FIG. 17 is a cross section of the cosmetic dispenser of FIG. 15 in an extended disposition.
Figure 20:
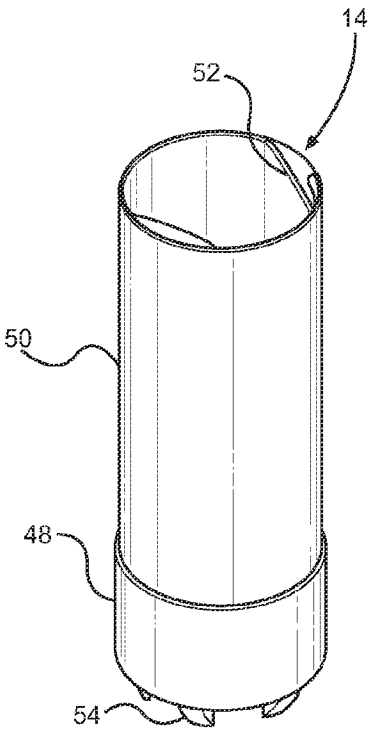
FIG. 20 is a perspective view of a spiral cam for the cosmetic dispenser of FIG. 15.

It will be understood that even further constructions are possible under the teachings set forth herein. By way of example and not limitation, an alternative embodiment of the cosmetic dispenser 10 is illustrated in FIGS. 15 through 17. The cosmetic dispenser 10 is again founded on a tubular inner body 12 that is rotatably engaged with a spiral member 14. Relative rotation between the inner body 12 and the spiral member 14 yields an axial movement of an elevator cup 18 and a retained pomade 100 between the extended disposition depicted in FIG. 17 and the retracted disposition depicted in FIG. 16. A tubular shell 16 again partially or substantially encases the distal portion of the spiral member 14 and, derivatively, the elevator cup 18 disposed therewithin. The elevator cup 18 can be as previously described and shown.

Figure 18:
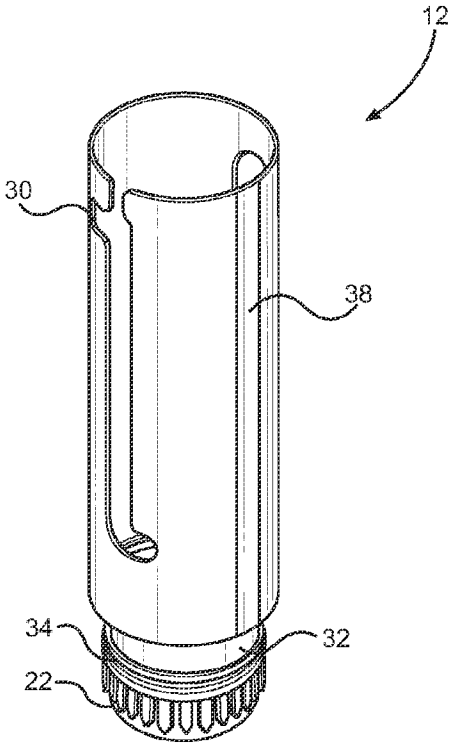
FIG. 18 is a perspective view of an inner body pursuant to the instant invention.
Figure 19:
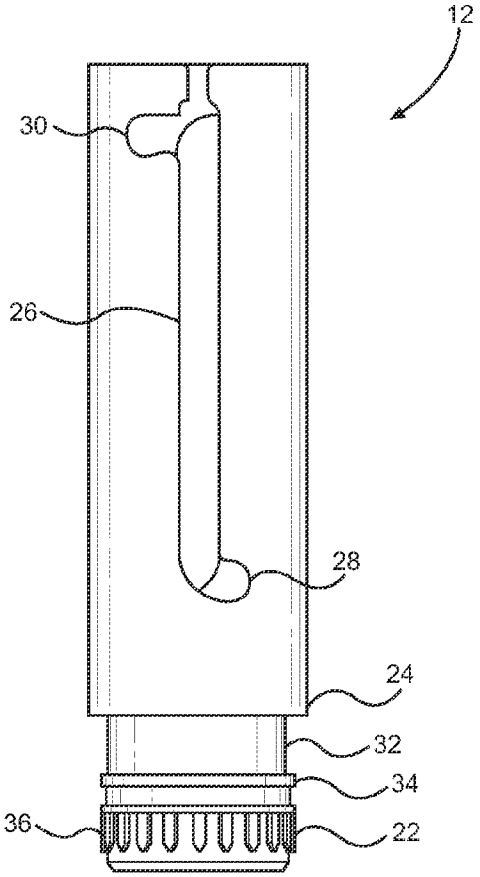
FIG. 19 is a view in front elevation of the inner body of FIG. 18.
Figure 23:
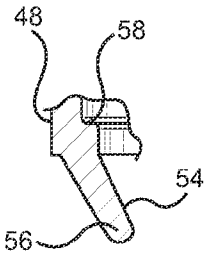
FIG. 23 is an amplified cross section of a friction tooth of the spiral cam of FIG. 20.
Figure 22:
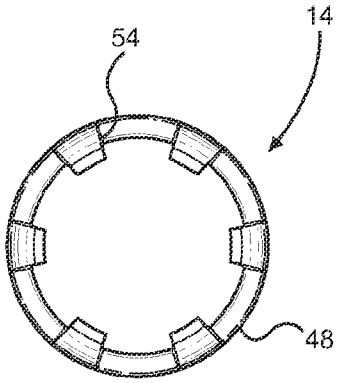
FIG. 22 is a bottom plan view of the spiral cam of FIG. 20.
Figure 21:
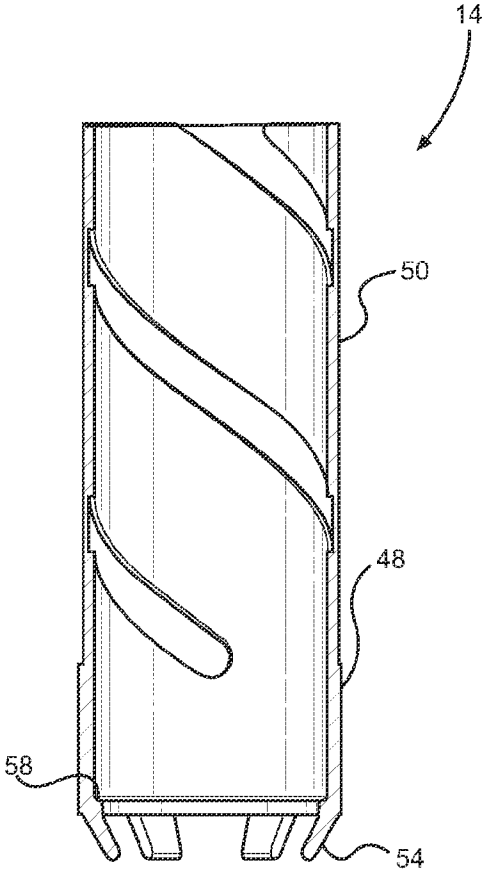
FIG. 21 is a cross section of the spiral cam of FIG. 20.

As before, the tubular inner body 12, which is shown apart in FIGS. 18 and 19, has a distally disposed body portion 24 for being received into a body portion 50 of the spiral member 14, which is seen alone in FIGS. 20 through 23. The inner body 12 has a base portion 22 disposed at a proximal end thereof, such as by being formed integrally therewith, and a smooth annular bearing wall 32 is interposed between the body portion 24 and the base portion 22. Again, the annular bearing wall 32 is concentric with the inner body 12 and longitudinally aligned with the body portion 24 and the inner body 12 in general. The annular bearing wall 32 thereby presents what can be referred to as a lateral bearing surface in that lateral force can bear against the annular bearing wall 32. It will again be noted that, except as the invention might be expressly limited by the claims, the lateral bearing surface formed by the annular bearing wall 32 could be otherwise disposed, such as at a mid-portion or at the distal end of the inner body 12.

In the present embodiment, however, the end cap 20 of the cosmetic dispenser 10 described above is foregone, and the base portion 22 of the inner body 12 acts as the actuating handle for the inner body 12. To facilitate that actuation, gripping ridges 36 are disposed directly on the base portion 22. A radially projecting ridge 34 is interposed between the gripping ridges 36 and the annular bearing wall 32. The radially projecting ridge 34 presents a smooth annular bearing surface that is concentric with and generally orthogonal to the axis of relative rotation of the inner body 12 and the spiral member 14. The smooth bearing surface of the ridge 34 thereby presents what can be referred to as a longitudinal bearing surface in that longitudinal force can bear against the smooth bearing surface of the ridge 34.

As in the previous embodiment, the inner body 12 has first and second opposed longitudinal tracks 26 that communicate along a substantial length of the body portion 24 of the inner body 12. The longitudinal tracks 26 are disposed in general opposition and pass entirely through the body portion 24 so that the elevator lugs 62 of the elevator cup 18 pass through the longitudinal tracks 26 to engage the opposed spiral channels 52 of the spiral member 14. The first and second longitudinal tracks 26 again have distal lateral track segments 30 at the distal ends thereof and proximal lateral track segments 28 at the proximal ends thereof for locking the elevator cup 18 in the extended and retracted positions respectively.

As before, the cylindrical spiral member 14, shown apart in FIGS. 20 through 23, has a proximally disposed skirt 48 and a distally disposed body portion 50. The skirt 48 has an outer diameter greater than the outer diameter of the body portion 50 so that the tubular shell 18 can be received to encase the body portion 50 as seen, for example, in FIGS. 15 through 17.

The spiral member 14 has an inwardly projecting shoulder 58 formed at the proximal end thereof. The shoulder 58 has an inner diameter marginally greater than the outer diameter of the annular bearing wall 32 of the inner body 12 but less than the outer diameter of the body portion 24 of the inner member 12. With that, the base portion 22 and the annular bearing wall 32 of the inner body 12 can be received through the proximal end of the spiral member 14 until the proximal end of the body portion 24 of the inner member 12 contacts the shoulder 58 of the spiral member 14 as illustrated, for example, in FIGS. 16 and 17.

A plurality of fingers 54 project proximally from the proximal end of the skirt 48 of the spiral member 14. More particularly, in this example, there are six fingers 54 spaced evenly at 60-degree intervals that extend proximally from the proximal end of the spiral member 14, but fewer or more fingers 54 are possible. The fingers 54 are integrally formed with the remainder of the spiral member 14, but that need not necessarily be the case. The fingers 54 are configured to establish a distance between the tips 56 of opposed fingers 54 and an effective circumference with the tips 56 of the fingers 54 tangent thereto smaller than the respective diameter and circumference of the annular bearing wall 32 of the inner body 12. In this example, the distance between tips 56 and the effective circumference are achieved by an inward angling of the fingers 54, but it could be otherwise achieved, such as but not limited to inward shoulders or steps or any other configuration. Moreover, the term "fingers" should not be interpreted as requiring any particular shape or configuration. When the cosmetic dispenser 10 is fully assembled as in FIGS. 15 through 17, the tips 56 of the fingers 54 thus press against the annular bearing wall 32 to provide smooth and consistent lateral frictional resistance to the rotation of the inner body 12 relative to the spiral member 14.

Moreover, the fingers 54 have longitudinal dimensions, which can be the same for each finger 54, sufficient to cause the ends of the fingers 54 to be in longitudinal frictional engagement with the smooth bearing surface of the ridge 34 that is in this embodiment integrally formed with the inner body 12. Further frictional resistance is thus created between the spiral member 14 and the inner body 12. Simultaneously, outward deflection of the fingers 54 is prevented by the smooth bearing surface of the ridge 34. The smooth bearing surface of the ridge 34 additionally acts as a rotary slidable mechanical restraint against the outward deflection of the fingers 54. Moreover, the engagement of the fingers 54, the annular bearing wall 32, and the smooth bearing surface of the ridge 34 cooperate to minimize or eliminate any relative longitudinal or lateral play between the components of the cosmetic dispenser 10 thereby further contributing to the perception of quality of the cosmetic dispenser 10 and the retained pomade 100.

The body portion 50 of the spiral member 14 has a smooth outer wall surface and an inner wall surface with spiral formations, which again comprise helical or spiral threads, ridges, channels 52 or some other formation, communicating therealong. The inner diameter of the distal body portion 50 of the spiral member 14 and the outer diameter of the peripheral wall 60 of the elevator cup 16 are calibrated to allow the elevator cup 18 to slide axially in relation to the spiral member 14, such as by having the outer diameter of the peripheral wall 60 be slightly less than or in a slight frictional engagement with the inner diameter of the distal body portion 50. Similarly, the elevator lugs 62 and the opposed spiral channels 52 can be dimensioned to enable a sliding of the elevator lugs 62 along the spiral channels 52, such as by having the distance between the outer tips of the elevator lugs 62 slightly less than or in slight frictional engagement with the diameter established by the spiral channels 52.

Consequently, the inner body 12 can be rotatably engaged with the spiral member 14 by having the body portion 24 of the inner body 12 received within the body portion 50 of the spiral member 14 with the fingers 54 of the spiral member 14 overlying and pressing laterally against the annular bearing surface 32 to provide lateral frictional resistance to the rotation of the inner body 12 relative to the spiral member 14. Simultaneously, the distal ends of the fingers 54 frictionally engage the bearing surface of the ridge 34 such that the fingers 54 press longitudinally against the bearing surface of the ridge 34 to provide longitudinal frictional resistance to rotation of the inner body 12 relative to the spiral member 14.

The elevator cup 18, and thus a pomade 100 retained by the elevator cup 18, can be manipulated between the extended configuration and the retracted configuration by a rotation of the inner body 12 in relation to the spiral member 14. To do so, a user could grip the inner body 12, such as by gripping the base portion 22 with a first hand, and then engage the spiral member 14 either directly or by use of the shell 16, such as with a second hand. Next, torque sufficient to rotate the inner body 12 in relation to the spiral member 14 can be applied. As the inner body 12 is rotated in relation to the spiral member 14, the elevator cup 18 will be prevented from rotating in relation to the inner body 12 by engagement of the lugs 62 with the longitudinal tracks 26, and the elevator lugs 62 will slide along the helical tracks 52 to yield an axial movement of the elevator cup 18 and the retained pomade. Relative rotation in a first direction will induce extension while relative rotation in a second, opposite direction will induce a retraction of the elevator cup 18 and the retained pomade.

With certain details and embodiments of the present invention for a cosmetic dispenser 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

I claim at least the following as deserving the protection of Letters Patent:

1. A cosmetic dispenser with frictional resistance for retaining a cosmetic pomade for extension and retraction the cosmetic dispenser comprising:

an inner body with a proximal end, a distal end, a body portion, and at least one longitudinal track that communicates along a substantial length of the body portion;

an elevator cup for retaining a pomade of cosmetic, the elevator cup comprising an annular peripheral wall, a base portion, and at least one lug that projects outwardly from the peripheral wall;

a spiral member with a proximal end, a distal end, and a body portion with at least one spiral formation along an inner surface thereof for engaging the at least one lug of the elevator cup wherein the spiral member and the inner body are rotatably engaged with a longitudinal axis of relative rotation with the body portion of the inner body received into the body portion of the spiral member;

a first annular bearing surface retained relative to the inner body or the spiral member and a second annular bearing surface retained relative to the inner body or the spiral member adjacent to the first annular bearing surface wherein the first annular bearing surface is disposed at a non-zero angle relative to the second annular bearing surface;

a plurality of fingers that project from the other of the spiral member or the inner body wherein the fingers are in slidable contact with both the first and second annular bearing surfaces whereby the fingers are restrained by the first annular bearing surface in a first direction and by the second annular bearing surface in a second direction;

wherein the first annular bearing surface comprises a lateral bearing surface substantially aligned longitudinally with the longitudinal axis of relative rotation whereby lateral force can be applied to the lateral bearing surface by the plurality of fingers;

wherein the second annular bearing surface comprises a longitudinal bearing surface that is not aligned with the longitudinal axis of relative rotation whereby longitudinal force can be applied to the longitudinal bearing surface by the plurality of fingers;

wherein the plurality of fingers are angled relative to the longitudinal axis of rotation with distal end portions in slidable contact with the first and second annular bearing surfaces.

2. The cosmetic dispenser of claim 1 wherein the first annular bearing surface has a diameter and a circumference and wherein the plurality of fingers establish an effective circumference with the fingers tangent thereto smaller than the circumference of the first annular bearing surface.

3. The cosmetic dispenser of claim 2 wherein the plurality of fingers are inwardly angled to establish the effective circumference with the fingers tangent thereto smaller than the circumference of the first annular bearing surface.

4. The cosmetic dispenser of claim 1 wherein the second annular bearing surface is generally concentric with and generally orthogonal to the longitudinal axis of relative rotation.

5. The cosmetic dispenser of claim 1 wherein the first annular bearing surface has a diameter and a circumference and wherein the plurality of fingers establish an effective circumference with the fingers tangent thereto smaller than the circumference of the first annular bearing surface.

6. The cosmetic dispenser of claim 1 wherein the plurality of fingers project from the spiral member and wherein the first and second annular bearing surfaces are retained relative to the inner body.

7. A cosmetic dispenser with frictional resistance for retaining a cosmetic pomade for extension and retraction, the cosmetic dispenser comprising:

an inner body with a proximal end, a distal end, a body portion, and at least one longitudinal track that communicates along a substantial length of the body portion;

an elevator cup for retaining a pomade of cosmetic, the elevator cup comprising an annular peripheral wall, a base portion, and at least one lug that projects outwardly from the peripheral wall;

a spiral member with a proximal end, a distal end, and a body portion with at least one spiral formation along an inner surface thereof for engaging the at least one lug of the elevator cup wherein the spiral member and the inner body are rotatably engaged with a longitudinal axis of relative rotation with the body portion of the inner body received into the body portion of the spiral member;

a first annular bearing surface retained by the inner body and a second annular bearing surface retained by the inner body adjacent to the first annular bearing surface wherein the first annular bearing surface is disposed at a non-zero angle relative to the second annular bearing surface;

a plurality of fingers that project from the spiral member wherein the fingers are in slidable contact with both the first and second annular bearing surfaces whereby the fingers are restrained by the first annular bearing surface in a first direction and by the second annular bearing surface in a second direction;

wherein the inner body has a base portion disposed at a proximal end of the inner body, wherein the base portion projects beyond the body portions of the inner body and the spiral member when the spiral member and the inner body are engaged, and wherein the first annular bearing surface comprises a smooth annular bearing wall interposed between the base portion of the inner body and the body portion of the inner body.

8. The cosmetic dispenser of claim 7 wherein the smooth annular bearing wall is generally concentric with and in substantial longitudinal alignment with the axis of relative rotation of the inner body and the spiral member.

9. The cosmetic dispenser of claim 8 wherein the second annular bearing surface is generally concentric with and substantially orthogonal to the first annular bearing surface.

10. The cosmetic dispenser of claim 7 further comprising a cap fixed to the base portion of the inner body wherein the second annular bearing surface is formed by a portion of the cap.

11. The cosmetic dispenser of claim 10 wherein the cap is retained by an annular ridge and facets on the base portion of the inner body.

12. The cosmetic dispenser of claim 7 wherein the second annular bearing surface is formed by an annular ridge retained by the inner body.

13. The cosmetic dispenser of claim 7 wherein the second annular bearing surface is generally concentric with and substantially orthogonal to the first annular bearing surface whereby the second annular bearing surface comprises a longitudinal bearing surface whereby longitudinal force can be applied to the longitudinal bearing surface by the plurality of fingers.

14. A cosmetic dispenser with frictional resistance for retaining a cosmetic pomade for extension and retraction, the cosmetic dispenser comprising:

an inner body with a proximal end, a distal end, a body portion, and at least one longitudinal track that communicates along a substantial length of the body portion;

an elevator cup for retaining a pomade of cosmetic, the elevator cup comprising an annular peripheral wall, a base portion, and at least one lug that projects outwardly from the peripheral wall;

a spiral member with a proximal end, a distal end, and a body portion with at least one spiral formation along an inner surface thereof for engaging the at least one lug of the elevator cup wherein the spiral member and the inner body are rotatably engaged with a longitudinal axis of relative rotation with the body portion of the inner body received into the body portion of the spiral member;

an annular lateral bearing surface retained by the inner body and an annular longitudinal bearing surface retained by the inner body adjacent to the annular lateral bearing surface wherein the lateral bearing surface is disposed at a non-zero angle relative to the longitudinal bearing surface;

a plurality of fingers that project from the spiral member wherein distal end portions of the fingers are in slidable contact with both the lateral and longitudinal bearing surfaces whereby the fingers are restrained by the lateral bearing surface in a lateral direction and by the longitudinal bearing surface in a longitudinal direction;

wherein the annular lateral bearing surface has a diameter and a circumference and wherein the plurality of fingers are inwardly angled to establish an effective circumference with the fingers tangent thereto smaller than the circumference of the annular lateral bearing surface.

15. The cosmetic dispenser of claim 14 wherein the lateral bearing surface is substantially aligned longitudinally with the longitudinal axis of relative rotation.

16. The cosmetic dispenser of claim 15 wherein the longitudinal bearing surface is generally concentric with and generally orthogonal to the longitudinal axis of relative rotation.

17. The cosmetic dispenser of claim 14 wherein the inner body has a base portion disposed at a proximal end of the inner body, wherein the base portion projects beyond the body portions of the inner body and the spiral member when the spiral member and the inner body are engaged, and wherein the annular lateral bearing surface comprises a smooth annular bearing wall interposed between the base portion of the inner body and the body portion of the inner body.

18. The cosmetic dispenser of claim 17 wherein the smooth annular bearing wall is generally concentric with and in substantial longitudinal alignment with the axis of relative rotation of the inner body and the spiral member and wherein the second annular bearing surface is generally concentric with and substantially orthogonal to the annular bearing wall.

19. The cosmetic dispenser of claim 18 further comprising a cap fixed to the base portion of the inner body wherein the annular longitudinal bearing surface is formed by a portion of the cap.

20. The cosmetic dispenser of claim 18 wherein the annular longitudinal bearing surface is formed by an annular ridge retained by the inner body.

* * * * *